US005350088A

United States Patent [19]

Smith

[11] Patent Number: 5,350,088

[45] Date of Patent: Sep. 27, 1994

[54] INVERTIBLE AEROSOL VALVE

[75] Inventor: Jeremy P. Smith, Louden, N.H.

[73] Assignee: Summit Packaging Systems, Inc., Manchester, N.H.

[21] Appl. No.: 119,624

[22] Filed: Sep. 13, 1993

[51] Int. Cl.[5] ..... B65D 83/00

[52] U.S. Cl. ..... 222/402.19; 222/402.1

[58] Field of Search ..... 222/321, 341, 376, 402.1, 222/402.19, 464, 481, 500; 239/334, 342; 137/38

[56] References Cited

U.S. PATENT DOCUMENTS

| | | | |
|---|---|---|---|
| 3,315,693 | 4/1967 | Braun | 222/402.19 |
| 3,542,254 | 11/1970 | Samuelson et al. | 222/402.19 |
| 4,723,692 | 2/1988 | Meuresch et al. | 222/402.19 |
| 4,775,079 | 10/1988 | Grothoff | 222/402.19 |
| 4,942,985 | 7/1990 | Schultz | 222/402.19 |
| 5,222,636 | 6/1993 | Meuresch | 222/321 |

FOREIGN PATENT DOCUMENTS

| | | | |
|---|---|---|---|
| 440855 | 8/1991 | European Pat. Off. | 222/402.19 |
| 2058229 | 4/1981 | United Kingdom | 222/402.19 |

*Primary Examiner*—Andres Kashnikow
*Assistant Examiner*—Philippe Derakshani
*Attorney, Agent, or Firm*—Dallett Hoopes

[57] ABSTRACT

An aerosol valve has a body with a circular side wall extending down beyond the floor of the body to define a socket. Into this socket is frictionally engaged a symmetrical appendage having a circular upper end and a tailpiece at its lower end. The body is vertically partitioned into a primary product passage communicating from the tailpiece upward through an opening in the floor of the main valve. On the other side of the partition the lower end of the chamber is provided with a valve seat with an opening communicating with the primary passage. A side opening is formed through the appendage above the valve seat, and a ball is adapted to seat on the valve seat when the container is in normal position. When the container is inverted, the ball drops away from the seat and permits passage of product through the side opening, through the valve seat opening into the primary passage and up into the valve for discharge.

7 Claims, 1 Drawing Sheet

INVERTIBLE AEROSOL VALVE

BACKGROUND OF THE INVENTION

1. Field of the Invention

This invention relates to an aerosol valve and more specifically to an aerosol valve which can be used in the inverted position. Still more specifically, the invention relates to a valve body and an appendage therefor which enables the valve to be used either end up.

2. Description of Related Art including Information Disclosed under §§1.97 to 1.99

There are already on the market and in the patent literature showings of aerosol valves adapted to be used when the container to which the valves are secured is disposed either end up. Some of these earlier valves are in the form of one-piece valve bodies having built thereinto second valve structure including a gravity-responsive ball which closes a second valve in series with the primary aerosol valve but which, when the container is inverted, drops away to permit product to pass in through the second valve and into the aerosol valve chamber.

An example of such a one-piece body is disclosed in the U.S. Pat. No. 4,723,692 to Meuresch et al which issued Feb. 9, 1988. In such arrangements having the second valve operated by the gravity-responsive ball disposed in the one-piece aerosol valve body the virtue is said to be reduction of the amount of plastic required in manufacture and easy positioning.

Another patent, U.S. Pat. No. 3,315,693 patented Apr. 25, 1967 by Arthur Braun, discloses an attachment which can be connected onto the tailpiece of an aerosol valve and which has a laterally disposed second valve operated again by a ball which falls away from the secondary seat when the container is inverted and permits product to enter from adjacent the second valve into the main aerosol body. The Braun patent has the advantage that the attachment described can be connected onto a conventional aerosol valve so that no special aerosol body need be made up specifically for invertible aerosol valve use as in Meuresch. The attachment of Braun suffers from a complete lack of symmetry which makes it awkward to handle in quantity production.

SUMMARY OF THE INVENTION

The disadvantages of prior patented structure—the requirement for a custom one-piece valve body and the difficulty in handling asymmetrical attachments—has been noted in the trade, and there has been a need for an arrangement wherein a symmetrical appendage can be connected up with an ordinary valve which is adapted for other uses so that no special valve body manufacture needs to be undertaken.

The invention, therefore, is for a standard aerosol valve having a body with circular side walls extending down beyond the floor of the valve body to define a socket. Into this socket is frictionally engaged, a symmetrical appendage having a circular upper end and a tailpiece central in its lower end. The body is vertically partitioned into a primary product passage line communicating from the tailpiece upward and through an opening in the floor of the main valve. On the other side of the partition the lower end of the chamber is provided with a valve seat having an opening communicating with the primary passage. A side opening is formed through the wall of the appendage above the valve seat, and a ball is adapted to seat on the valve seat closing the seat opening when the container is in normal position. When the container is inverted, the ball drops away from the seat and permits passage of product through the side opening, through the valve seat opening into the primary passage and up into the valve for discharge.

BRIEF DESCRIPTION OF THE DRAWINGS

Further objects and features of the invention will be apparent from the following specification and a study of the accompanying drawings, all of which disclose a non-limiting embodiment of the invention. In the drawings.

DESCRIPTION OF THE PREFERRED EMBODIMENT

Figure 1:
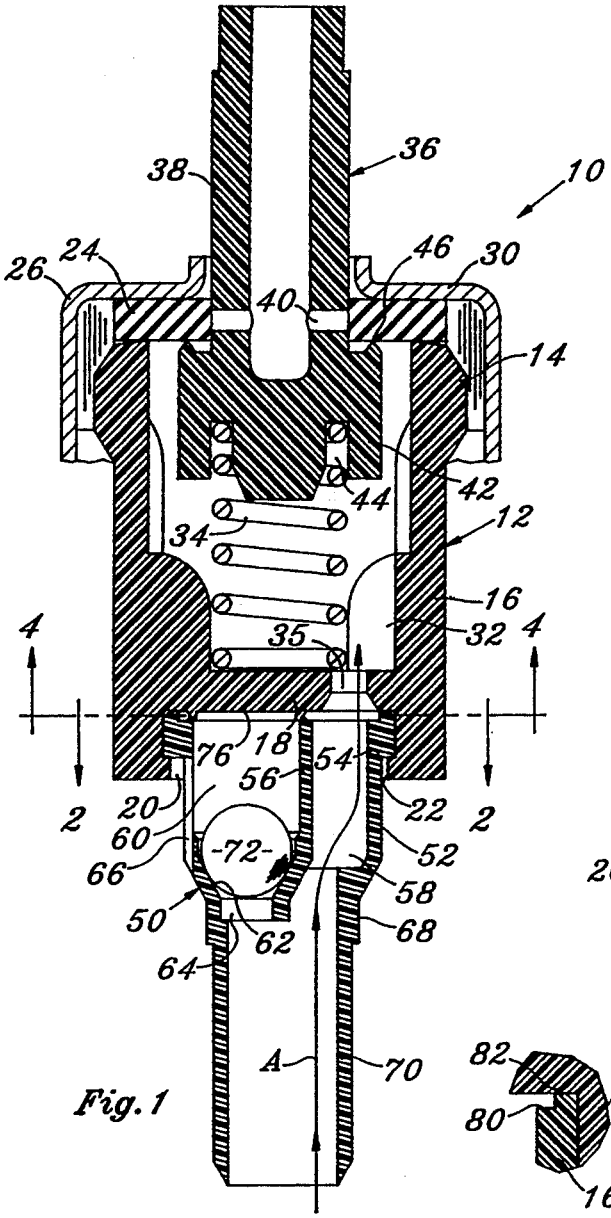
FIG. 1 is a center line section showing a valve embodying the invention and including the appendage and installed in a container which is shown only fragmentally. Portions of the valve stem and tailpiece are broken to conserve drawing space.

A valve embodying the invention is shown in FIG. 1 and generally designated 10. It comprises a body 12 which is generally cup-shaped and has a thickened mouth 14 with castellations there-around, a side wall 16 and a floor 18. As shown, the side wall 16 extends down below the floor 18 to present a socket 20 which may have a reduced mouth 22.

Across the top of the body is disposed an annular gasket 24 which is clamped in position by having the pedestal 26 of the mounting cup crimped inward against the underside of the thickened mouth 14. The top 30 of the pedestal is radial and clamps against the top of the gasket 24.

Locater ribs 32 are molded into the inside of the body between the floor 18 and the side wall 16. These serve not only to strengthen the floor but to center the lower end of a spring 34. The floor has a product inlet 35.

A valve element 36 is defined by a tubular upward stem 38, the stem having outward passage means 40 in the form of radial ducts. An enlarged head 42 is formed at the lower end of the valve element and centrally connected to the tubular stem 38. An annular recess 44 is provided in the underside of the head, and the upper end of the head may be formed with an annular sealing rib 46 which seats on the gasket 24. The outward passage means 40 are adjacent the head 42 and normally closed off by the gasket 24 when the valve element is in its upper position. The compression spring 34 compressively disposed between the floor 18 and the recess 44 urges the valve element upward.

An appendage 50 has a circular side wall 52 thickened outward as at 54 at its upper end. It is frictionally and sealingly engaged in the socket 20, the reduced mouth 22 and thickened portion 54 serving as detent means to retain the appendage in the socket. Inside the side wall 52, the appendage is vertically partitioned as at 56 into a primary passage 58 and a ball chamber 60 formed at its lower end with a conical seat 62 having a central bypass opening 64. The side wall 52 of the appendage is apertured as at 66 in the area of the ball chamber, above the seat 62.

As shown in FIG. 1, the side wall 52 of the appendage tapers downward inwardly as at 68 and connects with a dip tube tailpiece or nipple 70. The tailpiece 70 is tubular and the upper end communicates with both the vertical product passage 58 and the valve seat opening 64. The ball chamber 60 is provided with a gravity-responsive ball 72 which normally rests (FIG. 1) on the valve seat 62 closing off seat opening 64.

Figure 4:
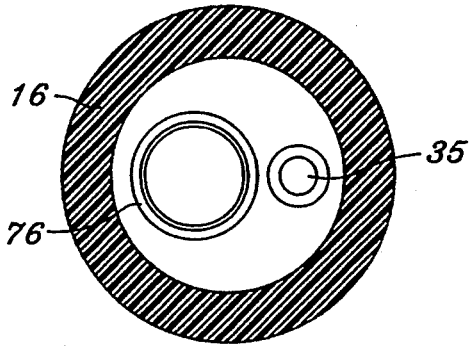
FIG. 4 is a sectional view taken on the line 4—4 of FIG. 1 and showing the bottom of the floor.

It is essential that the upper end of the ball passage 60 be sealed against the floor 18. For this purpose the upper end of the partition 56 and the adjacent arcuate portion of the appendage side wall 52 is formed with an upward circular rib 74. The underside of the floor (FIG. 4) is formed with an annular downward boss 76, and when the appendage is shoved home into the socket 20, the rib 74 presses continuously around the underside of boss 76.

Just as the ball chamber 60 must be sealed at its upper end, so too the upper end of the side wall 52 of the appendage 50 is formed with a chamfered edge 78. Chamfered edge 78 serves as a lead-in for the appendage when it is being installed past the mouth 22 of the socket 20. The inner portion of the upper end of the appendage is relieved inwardly as at 80 to provide a rib with a sharp edge 82 which presses sealingly against the bottom of the floor 18.

In assembly the inlet 35 in the valve body floor 18 lines up with the product passage 58 in the appendage and the boss 76 lines up with the rib 74.

As is well known, a dip tube (not shown) may be telescoped snugly over the tailpiece or nipple 70 and an actuator button (not shown) may be installed on the top of the stem 38.

In the usual right-side-up (FIG. 1) operation when the button is depressed and the valve is on, the product passes up the dip tube into the nipple 70 (flow line A) through the passage 58, inlet 35 and into the valve body 12. The sealing ring 46 is spaced down from the gasket 24 and product passes through the passage means 40 (down below the gasket 24), into the tubular stem 38 and out the actuator button orifice.

In the claims the terms such as "upward" and "downward" refer to relationships and directions when the valve is in the FIG. 1 right-side-up position.

Figure 3:
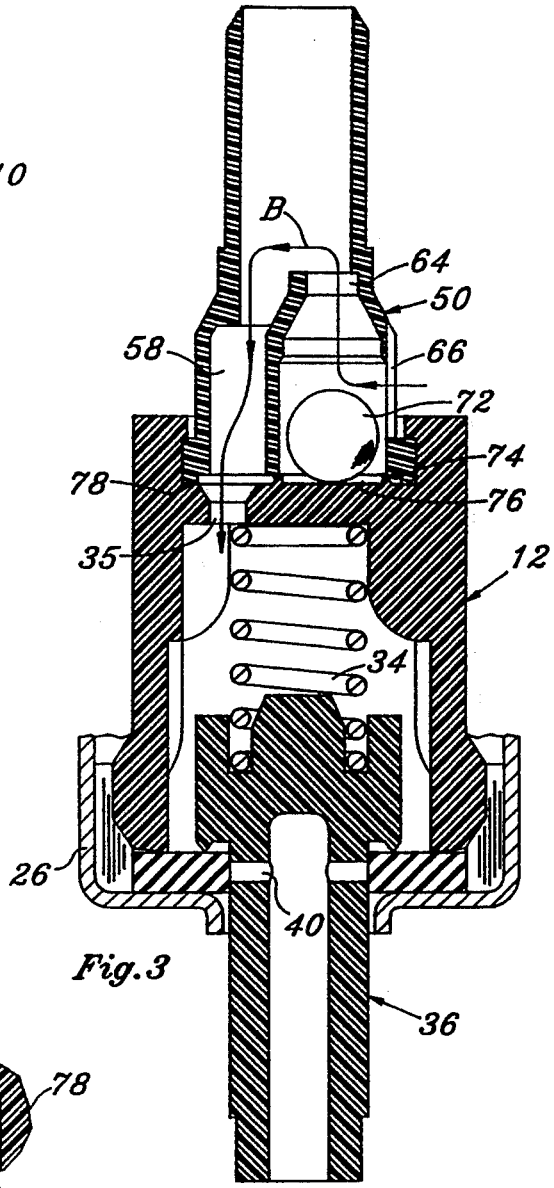
FIG. 3 is a view similar to FIG. 1 but showing the container inverted.
Figure 1A:
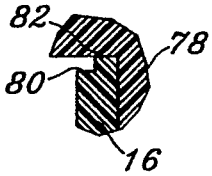
FIG. 1*a* is a greatly enlarged fragmentary view of the engagement of the top of the appendage and the valve body.
Figure 2:
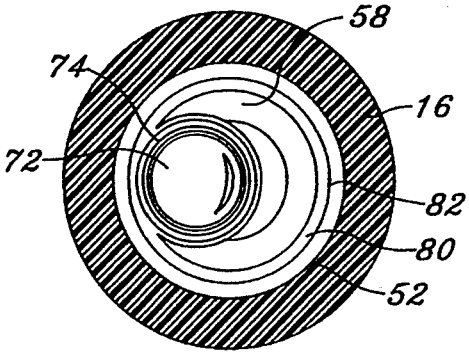
FIG. 2 is an sectional view taken on the line 2—2 of FIG. 1.

With the container and valve inverted as shown in FIG. 3, the path of the product (flow line B) is distinctly different when the button is depressed. It enters through the passage 66 into the ball chamber 60. Because the valve is inverted, the ball 72 has fallen away from its seat 62 and the product can pass through the seat opening 64 into the tailpiece 70 and down into the product passage 58 and through inlet 35 into the main valve chamber. With the valve depressed and as pushed upward, product in the main valve chamber will pass down and around the head 42 and into the outward passage means 40 which are above the gasket 24 (because the button is depressed). From thence the product passes into the tubular stem 38 and out the orifice of the actuator button (not shown).

It will be clear to those skilled in the art that unlike the prior art, the invention requires neither a special molded valve body nor is it misshapen because of an asymmetrical attachment. Instead, the invention provides a symmetrical appendage for attachment to a valve of conventional nature, the valve being useful with other attachments.

It should be understood that the invention is not limited to the embodiment shown but the invention is instead defined by the scope of the following claim language, expanded by an extension of the right to exclude as is appropriate under the doctrine of equivalents.

What is claimed is:

1. An invertible aerosol valve comprising:

a. a cup-shaped valve body having a circular side wall and a floor with an opening therethrough, the side wall of the body extending downward below the floor to define a downwardly facing circular socket, b. an annular resilient gasket sealingly secured across the top of the valve body, c. a valve element defined by a tubular upward stem sealingly surrounded by the gasket, and an enlarged head normally seating against the underside of the gasket, the stem having outward passage means through the tubular stem adjacent the head, the gasket normally sealing the passage means, d. spring means in the valve body urging the valve element upward toward seating, e. a bypass appendage having a cylindrical side wall frictionally and sealingly engaging in the socket and vertically partitioned inside into:

1. a ball chamber provided at its lower end with a bypass valve seat having a central seat opening, the ball chamber having an upper end closed off by the floor and a lateral opening therein above the seat to outside the appendage and, 2. a substantially vertical product passage to the side of the ball chamber, the lower end communicating with the bypass valve seat opening from therebelow, the upper end communicating with the opening in the floor in the valve body, f. a dip tube connected to the appendage and communicating with the lower end of the product passage, and g. a gravity-responsive ball in the ball chamber normally seating on the seat and valving it off but falling away from the seat when the aerosol valve inverted to permit passage of product through the lateral opening, through the seat opening, through the vertical product passage into the valve body and out the tubular stem when the aerosol valve stem depressed to unseal the passage means.

2. An invertible aerosol valve as claimed in claim 1 wherein the upper end of the appendage is formed with an upward annular edge tapered toward its distal end to abut the undersurface of the floor of the valve body to assist in the sealing of the appendage to the valve body.

3. An invertible aerosol valve as claimed in claim 1 wherein the partition along with a portion of the side wall of the appendage forms a ball chamber wall circular in horizontal cross-section.

4. An invertible aerosol valve as claimed in claim 3 wherein the undersurface of the floor of the valve body has a downward annular boss in alignment therewith and the top of the ball chamber wall has a longitudinally extending sealing rib which engages about the boss to seal the upper end of the ball chamber.

5. An invertible aerosol valve as claimed in claim 1 wherein the appendage has a depending tailpiece to which the dip tube is connected.

6. An invertible aerosol valve as claimed in claim 1 wherein the frictional engagement of the appendage in the socket is enhanced by detent means.

7. An invertible aerosol valve as claimed in claim 6 wherein the detent means is a thickened mouth about the inside of the socket about its lower end and an outward thickening about the upper end of the appendage.

* * * * *